US005188460A

United States Patent [19]

Dorse

[11] Patent Number: 5,188,460

[45] Date of Patent: Feb. 23, 1993

[54] LIQUID STORAGE BAG

[75] Inventor: John R. Dorse, Pietermaritzburg, South Africa

[73] Assignee: BTR Dunlop Limited, Natal, South Africa

[21] Appl. No.: 581,421

[22] Filed: Sep. 13, 1990

Related U.S. Application Data

[63] Continuation of Ser. No. 317,399, Mar. 1, 1989, abandoned.

[30] Foreign Application Priority Data

Mar. 2, 1988 [ZA] South Africa ..... 88/1469

[51] Int. Cl.[5] ..... B65D 30/10; B65D 33/02; B65D 33/14

[52] U.S. Cl. ..... 383/18; 220/403; 383/105; 383/125; 383/907

[58] Field of Search ..... 383/105, 18, 907, 121, 383/125, 126; 220/403, 404; 410/117; 229/87.01, 87.08, 87.18

[56] References Cited

U.S. PATENT DOCUMENTS

| | | | |
|---|---|---|---|
| 2,696,235 | 12/1954 | Toffolon | 383/18 |
| 3,082,927 | 3/1963 | Winstead | 220/403 |
| 3,221,979 | 12/1965 | Hurewitz | 383/105 |
| 3,825,172 | 7/1974 | Mollura | 383/105 |
| 3,951,284 | 4/1976 | Fell et al. | 220/404 |
| 4,232,803 | 11/1980 | Muller et al. | 220/404 |
| 4,441,627 | 4/1984 | Takeuchi | 383/4 |
| 4,449,279 | 5/1984 | Takeuchi | 383/4 |
| 4,674,127 | 6/1987 | Yamada et al. | 220/404 |
| 4,688,979 | 8/1987 | Kupersmit | 220/409 |
| 4,801,042 | 1/1989 | Hamada et al. | 220/404 |
| 4,875,596 | 10/1989 | Lohse | 220/403 |
| 4,877,281 | 10/1989 | Altmann | 220/404 |

FOREIGN PATENT DOCUMENTS

| | | | |
|---|---|---|---|
| 331491 | 6/1989 | European Pat. Off. | 383/104 |
| 505195 | 12/1954 | Italy | 229/87.08 |

*Primary Examiner*—Stephen P. Garbe
*Attorney, Agent, or Firm*—Nixon & Vanderhye

[57] ABSTRACT

The invention provides a storage bag of flexible sheet material characterized in that it is of generally rectangular configuration comprising a planar base section, opposed generally vertically disposed side wall sections, opposed generally vertically disposed end wall sections and a generally planer roof section. The invention also provides a harness for containing the storage bag within a standardized for transport purposes. The invention further provides a blank for forming the storage bag and a method of folding and joining the blank to form the storage bag.

5 Claims, 9 Drawing Sheets

LIQUID STORAGE BAG

This is a continuation of application Ser. No. 07/317,399 , filed Mar. 1, 1989, now abandoned.

FIELD OF THE INVENTION

This invention relates to a storage bag which is particularly suitable for transportation in a container. The bag of the invention will mainly find application in the storage of liquids, but is not limited to such application.

BACKGROUND OF THE INVENTION

Conventionally when liquid storage bags are housed within ISO containers, a bulkhead/pallet is provided with the bulkhead disposed adjacent to and supported by the doors of the container, such bulkhead/pallet serving to prevent the bag from bulging out of the container during filling and discharge operations. It will be appreciated that such a bulkhead/pallet arrangement adds weight to a load, and is also space consuming particularly in relation to an empty storage bag.

OBJECT OF THE INVENTION

It is accordingly an object of the present invention to provide a novel storage bag and accessories therefore which it is believed will overcome or at least minimize the difficulties mentioned above.

SUMMARY OF THE INVENTION

According to the invention, a storage bag made of flexible sheet material is characterized in that it is of generally rectangular configuration, comprising a generally planar base section, opposed generally vertically disposed side wall sections, opposed generally vertically disposed end wall sections, and a generally planar roof section. The term "generally vertically wall section" herein is meant to include an upwardly directed slanting wall section.

In a preferred arrangement the bag will comprise a tubular section defining the base, side walls and roof, with rectangular end wall sections being secured to each end of the tubular section. Preferably the end wall sections will be constituted by two sections which fold towards one another from the side wall sections or alternatively from the roof and base sections.

In one arrangement where the side wall sections and end wall sections are substantially vertically disposed, the end wall sections will be constituted by two half sections of substantially equal size. Alternatively, where the side wall and end wall sections either converge or diverge upwardly, the end wall sections will be constituted by unequal sections.

Where the bag is housed in a rigid container, it may further include a reinforcing harness comprising a plurality of strap elements whereof the free ends are adapted to be secured to the container, preferably to the floor thereof. In a preferred embodiment, the reinforcing harness will include two or more longitudinal straps extending over the end sections and the roof of the bag, and one or more transverse straps extending over the side wall sections and the roof of the bag. Preferably two longitudinal straps will be provided, the straps diverging outwardly at the end panels towards the lower bottom corners of the bag. With the latter arrangement a series of cross-brace straps will preferably be provided to link the outwardly diverging straps together at intervals at one or both end zones thereof.

Also included within the scope of the invention is a blank of elastomeric or plastic sheet material which may or may not be reinforced with fabric for forming the bag of the invention, as disclosed herein.

DESCRIPTION OF THE DRAWINGS

In order to illustrate the invention two embodiments thereof will be described hereunder purely by way of example with reference to the accompanying drawings wherein.

DETAILED DESCRIPTION OF THE INVENTION

Referring to FIGS. 1 to 8 of the drawings, one embodiment of a liquid storage bag in accordance with the invention is characterised in that it is of generally rectangular configuration comprising a base panel 10, a pair of opposed side panels 11 and 12, a pair of opposed end panels 13 and 14 and a roof panel 15.

Figure 4:
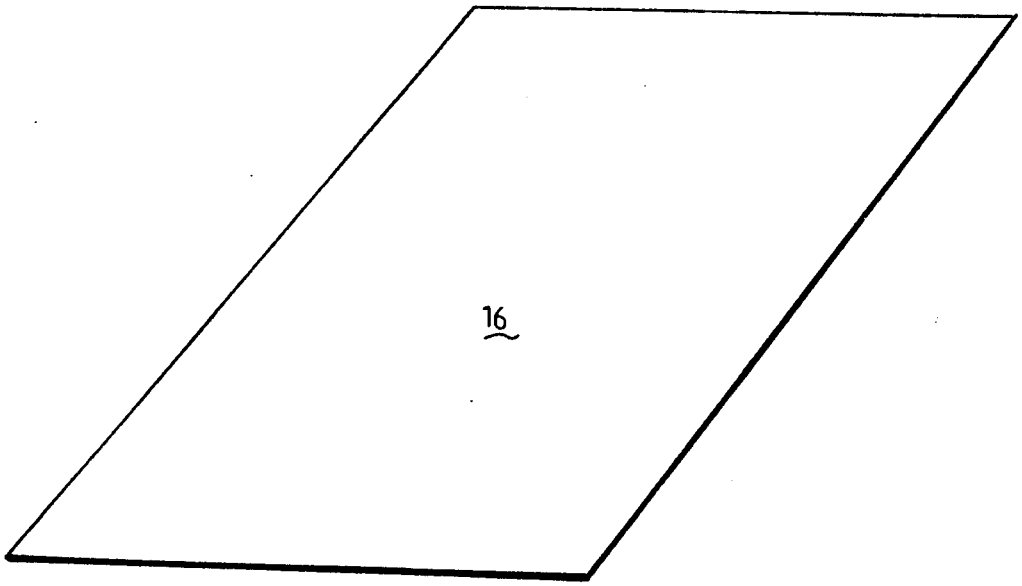
FIG. 4 is a plan view of a blank of elastomeric or plastic sheet material for use in the formation of the bag of the invention. Such a blank may consist of one or more panels joined by suitable seams.
Figure 5:
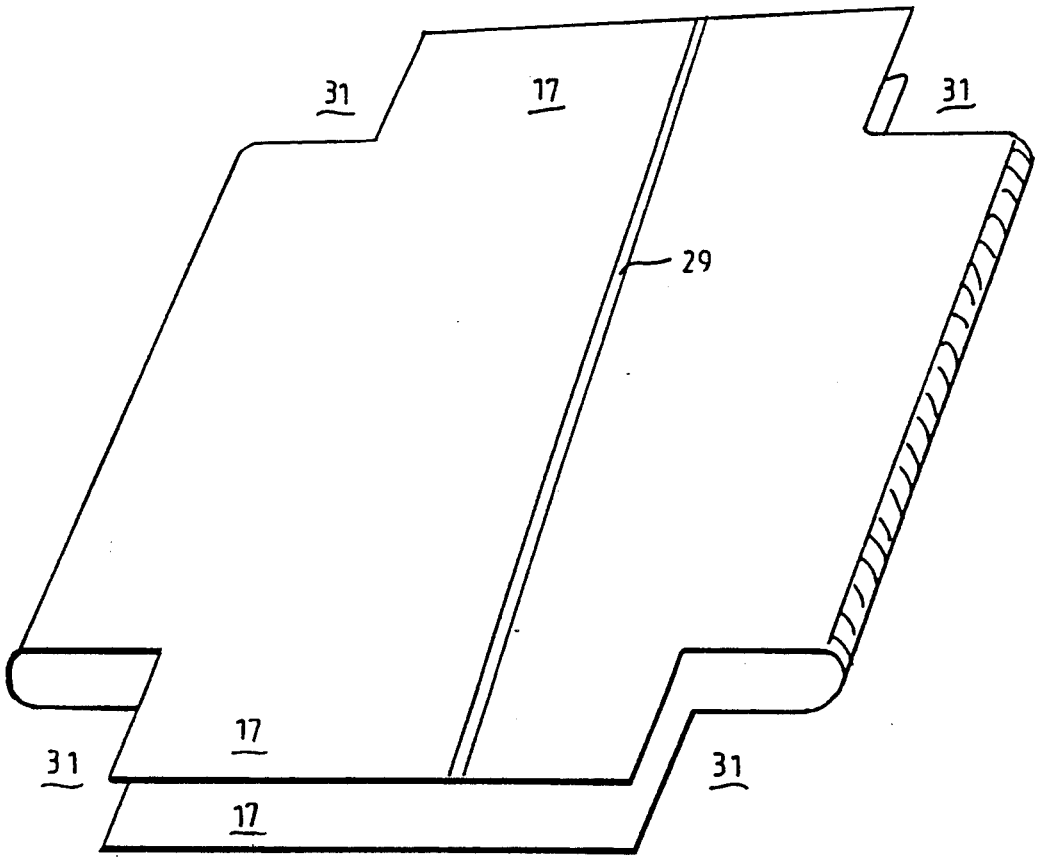
FIG. 5 is a schematic illustration of the blank which has been joined together to form a sleeve or tube open at each end which has then had the corner cutouts removed providing tongues to form end panels.
Figure 6:
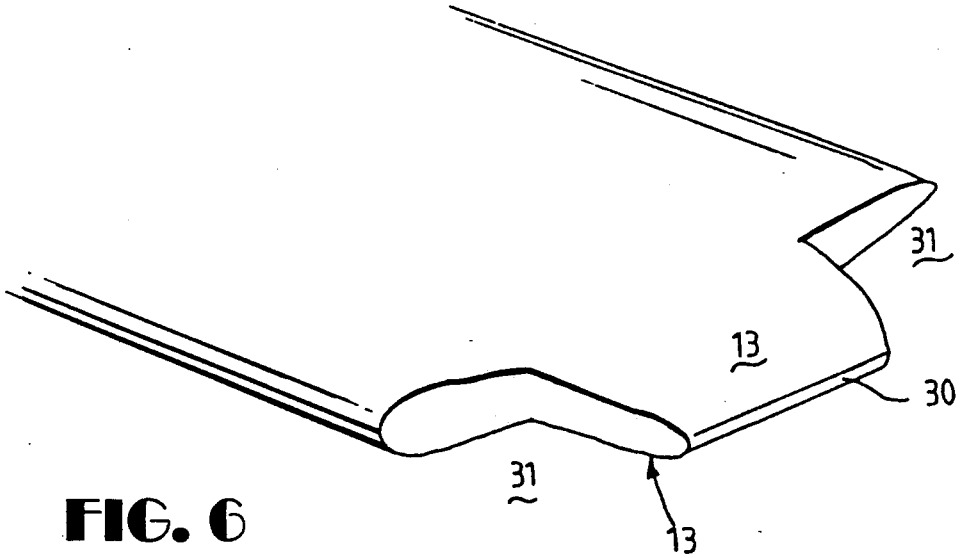
FIG. 6 illustrates the horizontal seam joining the tongues to form the end panel.

With reference to FIG. 4 the bag will be formed from a blank 16 which is of rectangular shape. By means of a longitudinal joint 29 this blank is formed into a tubular configuration. Square cutouts 31 are made in the tube to form a pair of tongues 17 at each end as illustrated in FIG. 5. The tongues 17 are joined by seams 30 to make the end panel 13 as shown in FIG. 6.

Figure 7:
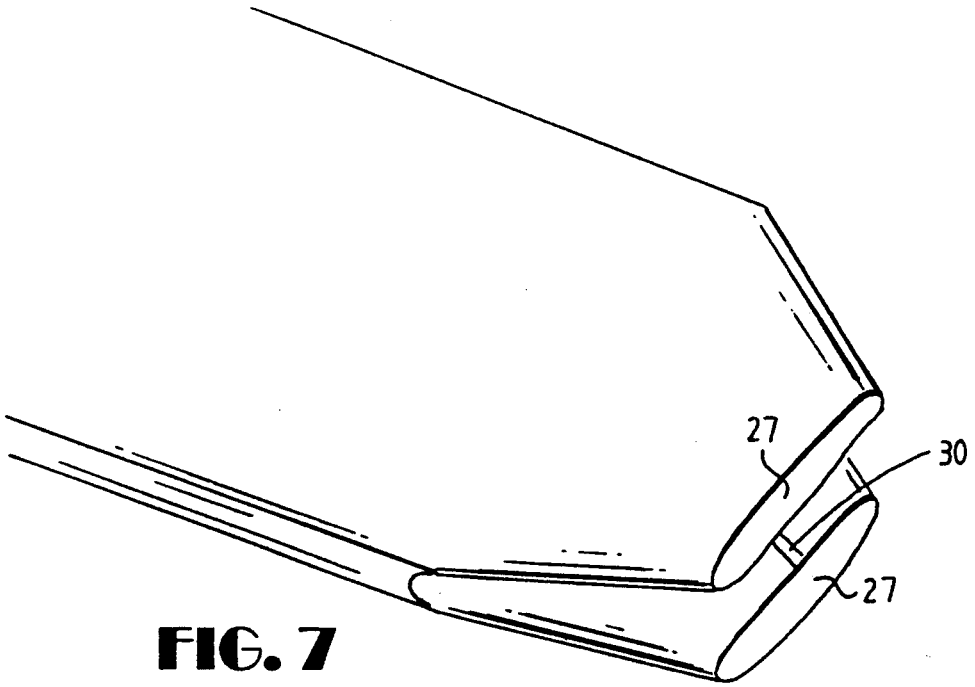
FIG. 7 is a schematic illustration of the folded end of the bag with the cutouts arranged to provide the seams which form the ends of the side or vertical panels.

The ends are folded as shown in FIG. 7 in such a manner that the pair of cutouts 31 are transformed into two openings 27 lying one above the other each of which can be joined to form the vertical end seams 18 of the bag.

The seams of the bag will be sealed in a conventional manner with additional reinforcement where necessary. A bag formed as above and depicted in FIG. 8 will be of a generally rectangular profile and particularly suitable for housing within a rigid container 19 such as a conventional ISO container. It is envisioned that the bag will be dimensioned to be a snug fit within the container 19.

Figure 11:
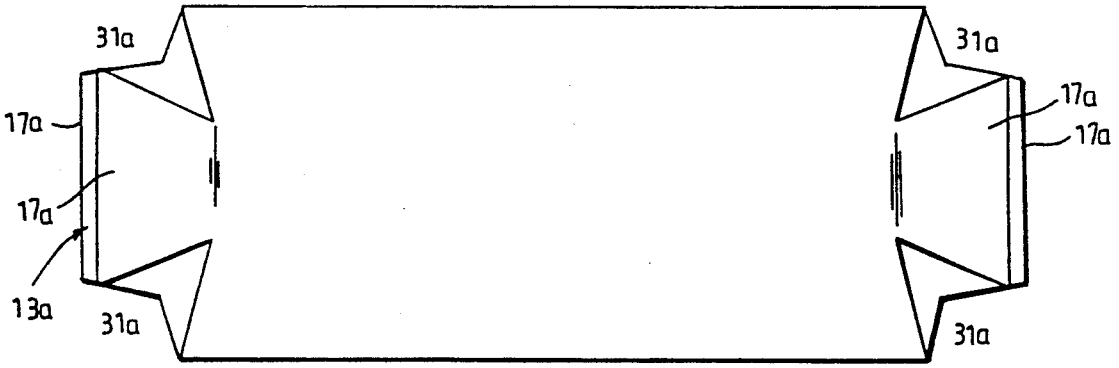
FIG. 11 is a schematic illustration of the blank in FIG. 10 which has had corner cutouts removed therefrom to provide tongues to form the end panels.
Figure 12:
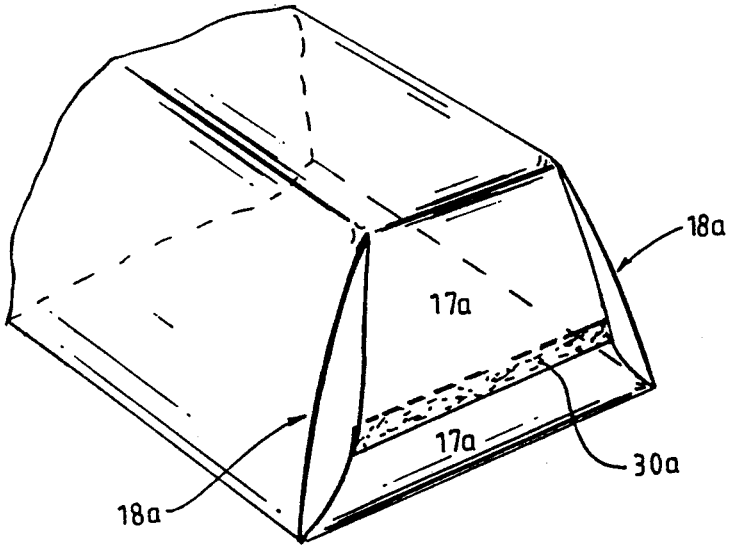
FIG. 12 is a schematic illustration of the folded end of the bag in FIG. 9 arranged to provide the seams at the junction between the end and side panels.
Figure 11A:
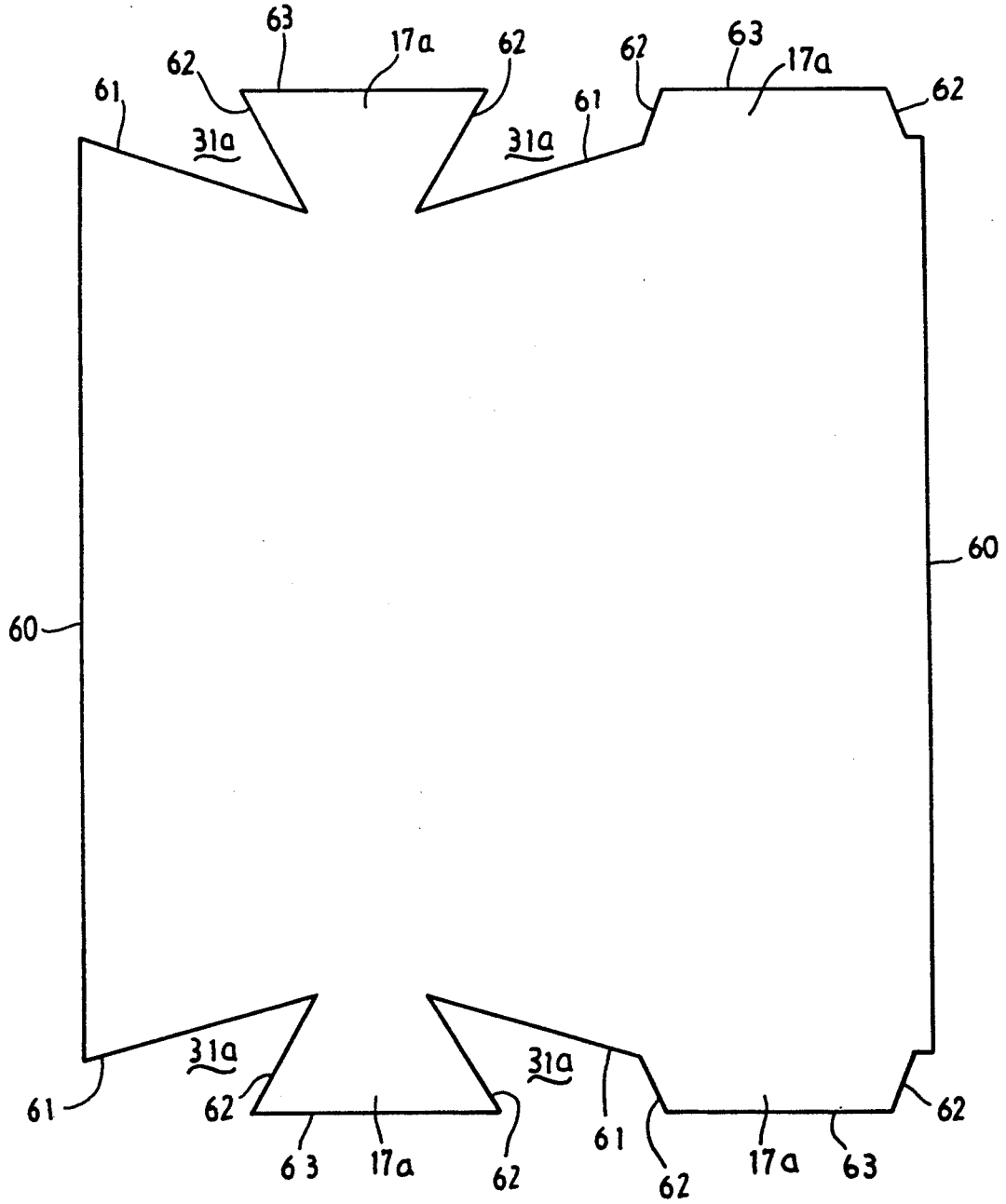
FIG. 11A is a schematic illustration of the blank in FIG. 11 opened out into a flat configuration.

The bag shown in FIG. 8 will preferably be provided with a harness as described in more detail below and housed within the container 19. An alternative arrangement is shown in FIGS. 9 to 12 which show a version of the bag having side and end walls which slope upwardly in a convergent fashion and which is designed to be free standing within a container 19 without the need for a harness or other supporting devices. It will be noted that the bag is of generally trapezoidal profile. The bag is formed in a similar manner to the bag shown in FIG. 8, by utilizing a blank of rectangular shape, shown in FIG. 11A, which is formed into a tubular configuration by means of a longitudinal joint 29*a*, FIG. 10. The difference in construction is found in the cutouts 31*a* which are not square, but of angled shape as shown in FIGS. 11 and 11A. As seen in FIG. 11A, the blank comprises a rectangular panel having opposed side edges 60 and opposed end edges 61, with a pair of spaced part end wall panel sections 17*a* projecting from each end edge 61. Each part end wall panel section 17*a* defines panel side edges 62 and a panel end edge 63. Adjacent part end wall panel sections 17*a* are arranged so that the panel end edges can be joined together to constitute an end wall section of the bag, in which at each end edge 61 of the rectangular panel the panel side edges 62 of one part end panel section 17*a* diverge outwardly towards the panel end edge 61 while the panel side edges 62 of its adjacent end wall panel section 17*a* converge inwardly towards the panel and edge 61. The length of the panel end edges 63 of each part end wall panel sections 17*a* are substantially equal. As a result of the cutouts 31*a*, tongues 17*a* are of unequal size. The tongues 17*a* are joined by a seam 30*a* and the ends folded in the manner shown in FIG. 12 to provide angled end seams 18*a*. The seams 18*a* will be sealed in a conventional manner with additional reinforcement where necessary.

Figure 9:
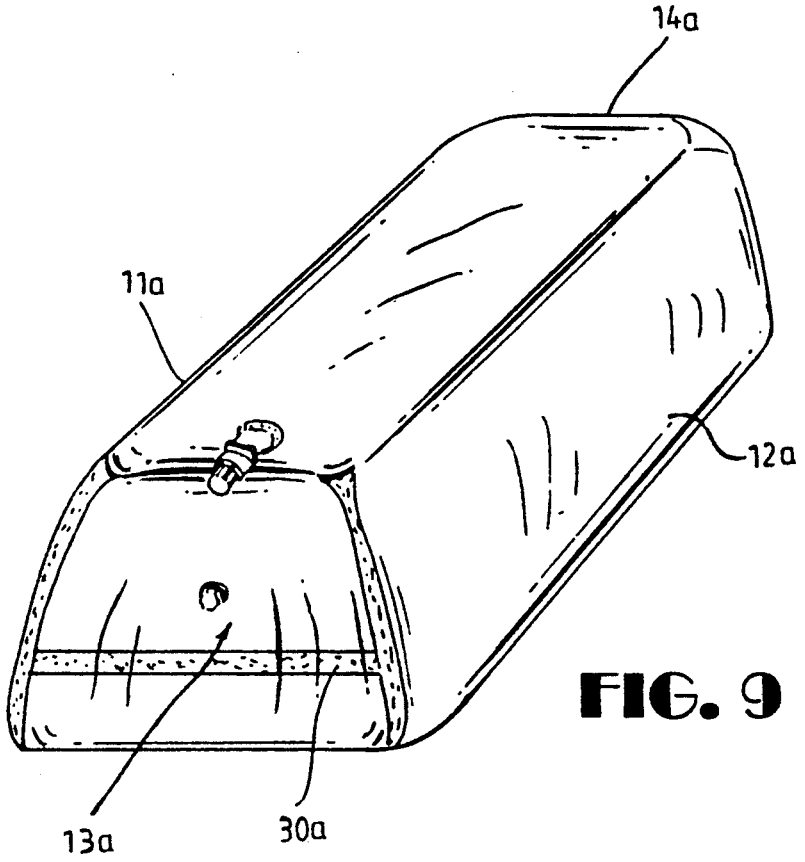
FIG. 9 is a perspective schematic view of a different embodiment of the arrangement shown in FIG. 8, with the side and end wall sections of the bag converging upwardly.
Figure 10:
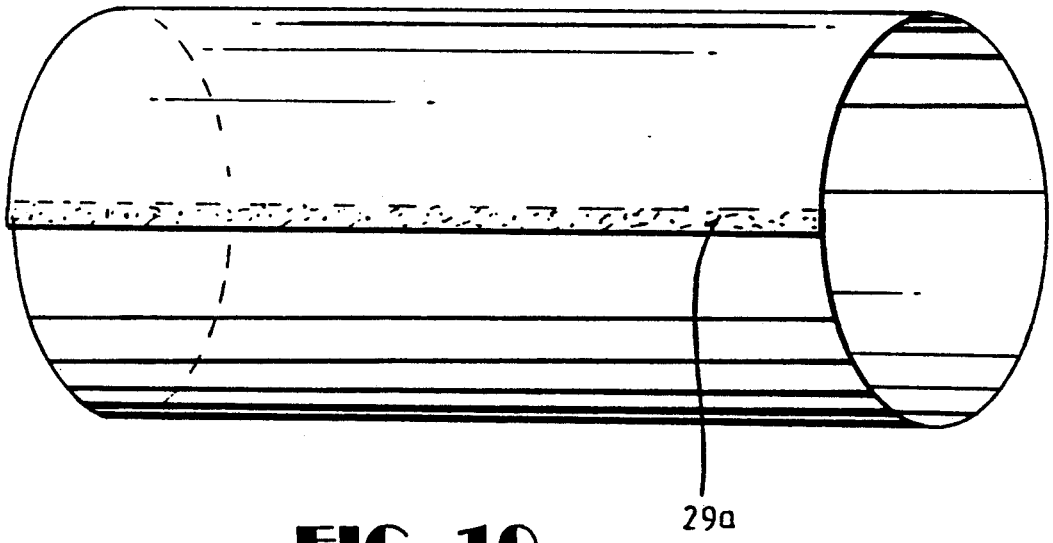
FIG. 10 is a schematic illustration of a blank for forming the bag in FIG. 9, which has been joined longitudinally to form a sleeve.

It has been found that the bag of FIG. 9 is substantially self supporting and when housed within a container will not impinge on the container wall. Accordingly the bag will usually not require constraining means such as a harness or the like.

Figure 1:
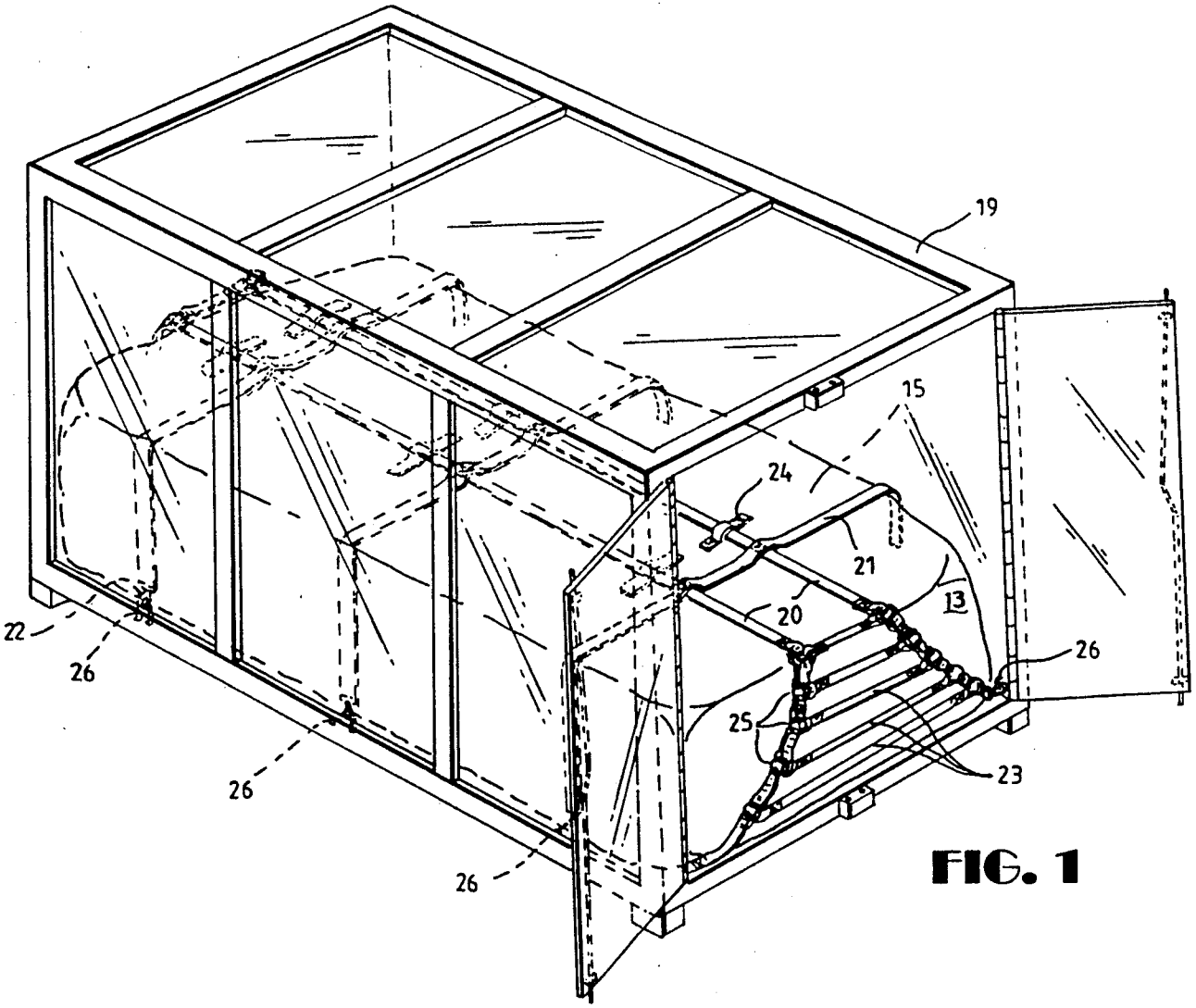
FIG. 1 is a schematic perspective view of a storage bag in accordance with the invention positioned within a container.
Figure 2:
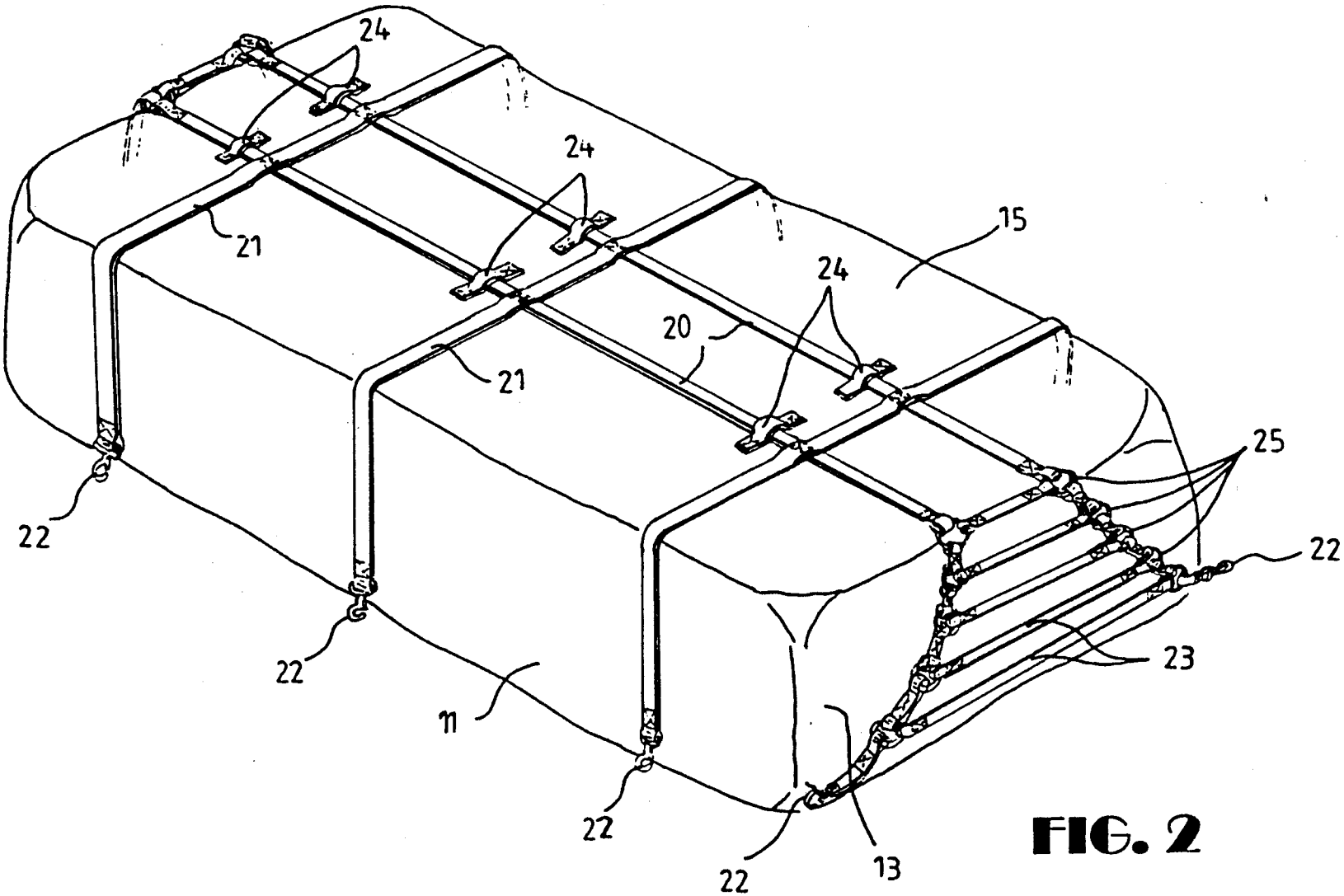
FIG. 2 is a perspective view of a bag in accordance with the invention together with a harness therefor.
Figure 3:
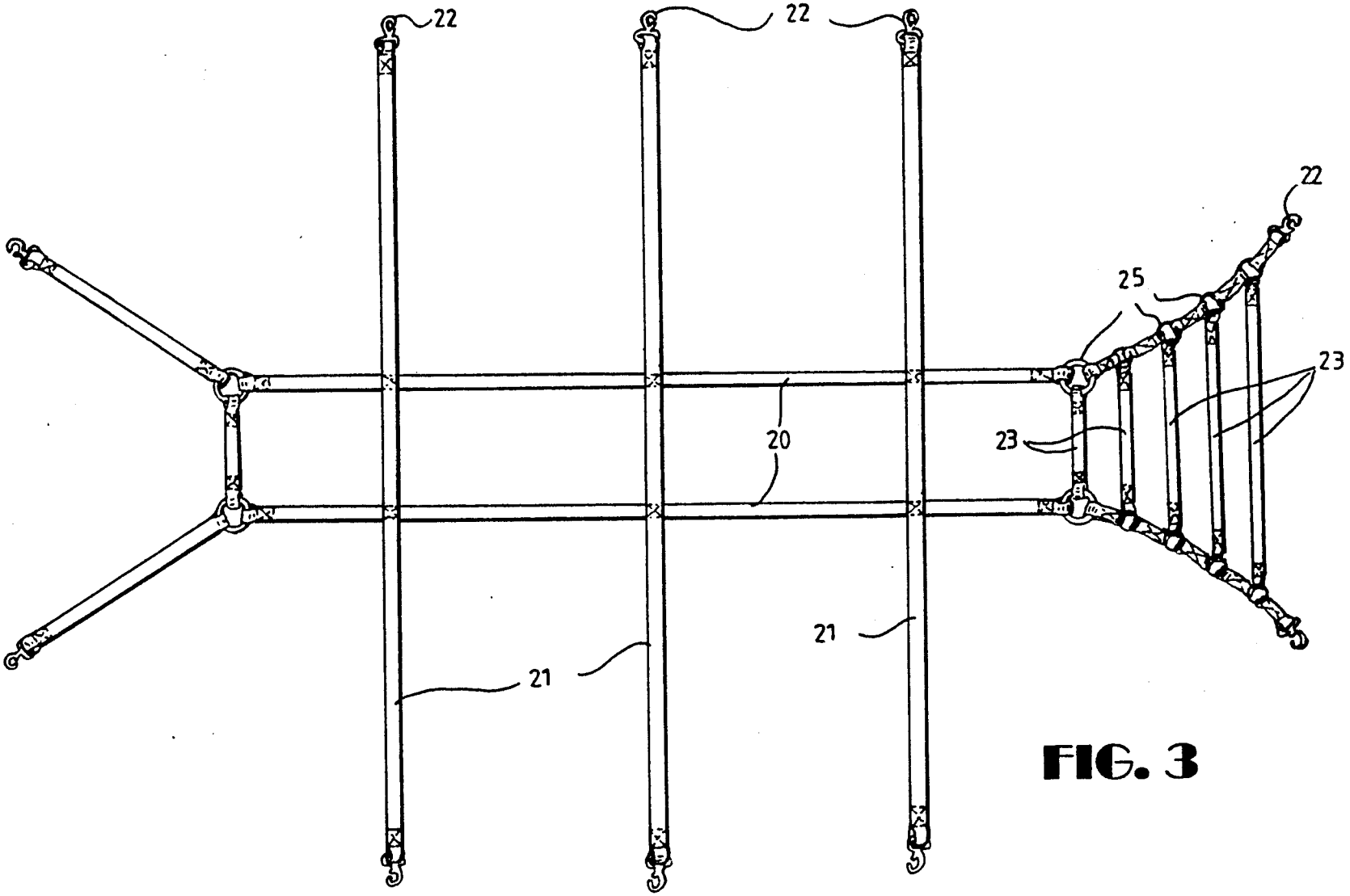
FIG. 3 is a plan view of a harness for use with the bag of the invention.
Figure 8:
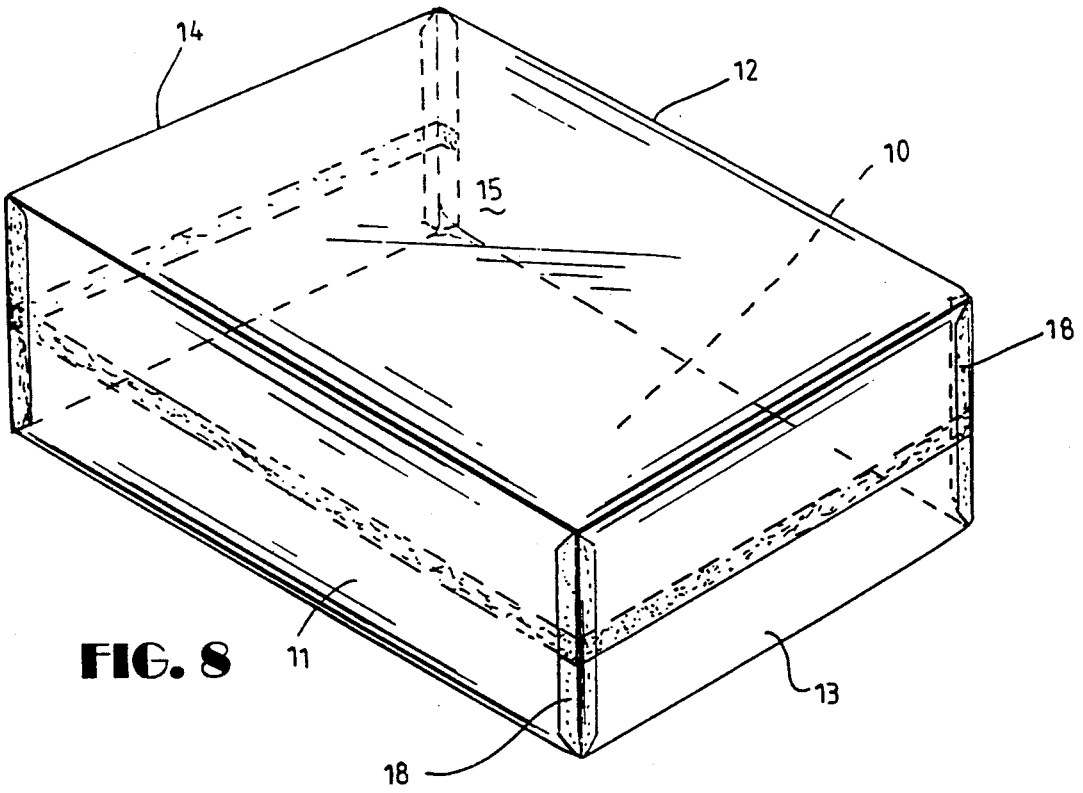
FIG. 8 is a schematic illustration of the bag with all panels seamed to constitute the storage bag of the invention.

As mentioned above the harness of FIG. 3, may be provided for the embodiment of the bag shown in FIGS. 1, 2 and 8 to control movement thereof, during filling, discharge and transportation. Loops 24 will secure the harness to the bag, FIG. 2. In the preferred arrangement illustrated, the harness comprises a pair of longitudinal strap elements 20 and a plurality of transverse strap elements 21. The longitudinal strap elements extend from the lower corner zones of the container along one end panel 14 of the bag over the upper surface 15 thereof, and along the other end panel 13 of the bag. A suitable hook, clasp or the like formations 22 will be provided for securing the ends of the strap elements to eye formations 26 or the like provided on the floor of the container 19 and adjacent to the walls. The longitudinal strap elements 20 are reinforced at least at the door side of the container by means of a plurality of spaced transverse linking straps 23 provided in the zone of the end panel of the bag. It has been found that the longitudinal straps 20 together with these linking straps 23 will limit excessive surge movement of the end preventing the bag from exerting undue stress on or even bulging out of the door of the container.

It will be appreciated that the linking straps 23 define the contour of the end portions of the strap elements 20. Ring elements serve to link the various strap elements together as shown in FIG. 2. The transverse straps 21 of the harness extend transversely across the roof 15 of the bag and down each side panel 11 and 12 thereof as illustrated.

The advantages of the arrangement of the invention will be apparent to persons skilled in the art. It will be readily apparent that by dispensing with the conventional pallet/bulkhead, both the transportation of full storage bags as well as the return of empty bags will be more economical and less problematic.

Clearly many variations of the invention exist without departing from the principles set out in the consistory clauses. The invention relates to a novel storage bag, a blank for forming such a bag, a harness for use with the bag as well as a transportation system comprising the bag with or without the harness of the invention in combination with a rigid container.

I claim:

1. A storage bag of flexible sheet material, said bag being of generally rectangular configuration, said bag comprising:

a planar base section;

opposed upwardly directed side wall sections;

a generally planar roof section;

opposed upwardly directed end wall sections, said end wall sections being constituted by part sections which fold towards one another from the side wall sections or alternatively from said roof and base sections to define a truncated triangular end wall section, said part sections being of unequal length with respect to each other; and a reinforcing harness comprising a plurality of strap elements having free ends securable to the interior of a container.

2. The bag according to claim 1, wherein said free ends are securable to the floor of said container.

3. The bag according to claim 1, wherein the reinforcing harness includes two or more longitudinal straps extending over the end sections and roof section of the bag and one or more transverse straps extending over the side wall sections and the roof section of the bag.

4. The bag according to claim 3, wherein the harness comprises two longitudinal straps which diverge outwardly at the end of the bag towards the lower bottom corners of the bag with a series of cross-brace straps being provided to link the outwardly diverging straps together at intervals at one or both end zones of said harness.

5. A blank for forming a storage bag, comprising:

a panel having opposed sides and opposed ends; and a pair of spaced part end wall panel sections projecting from each end of said panel, each part end wall panel section defining panel side edges and a panel end edge, said part end wall panel sections in each said pair being arranged so that the panel end edges can be joined together to constitute an end wall section of the bag, wherein at each end of the panel the panel side edges of one part end panel section of said pair diverge outwardly towards the panel end edge while the panel side edges of the other part end wall panel section of said pair converge inwardly toward the panel end edge, the length of the panel end edges of each part end wall panel section being substantially equal.

* * * * *